US009022690B2

(12) United States Patent
Trottier

(10) Patent No.: US 9,022,690 B2
(45) Date of Patent: May 5, 2015

(54) CABLE RECOVERY DEVICE AND SYSTEM

(71) Applicant: Gaetan Trottier, Etobicoke (CA)

(72) Inventor: Gaetan Trottier, Etobicoke (CA)

( * ) Notice: Subject to any disclaimer, the term of this patent is extended or adjusted under 35 U.S.C. 154(b) by 25 days.

(21) Appl. No.: 13/755,513

(22) Filed: Jan. 31, 2013

(65) Prior Publication Data

US 2014/0212222 A1 Jul. 31, 2014

(51) Int. Cl.

| | |
|---|---|
| ***E02F 5/14*** | (2006.01) |
| ***E02F 3/96*** | (2006.01) |
| ***E02F 5/00*** | (2006.01) |
| ***E02F 5/02*** | (2006.01) |
| ***E02F 9/20*** | (2006.01) |

(52) U.S. Cl.

CPC ..... *E02F 3/961* (2013.01); *E02F 5/003* (2013.01); *E02F 5/027* (2013.01); *E02F 5/145* (2013.01); *E02F 9/2016* (2013.01)

(58) Field of Classification Search

CPC ..... E02F 3/961; E02F 5/003; E02F 5/027; E02F 5/145

USPC ..... 405/154.1, 174, 180, 181, 183, 184, 405/184.4; 37/413; 171/45, 46, 141

See application file for complete search history.

(56) References Cited

U.S. PATENT DOCUMENTS

| | | | | |
|---|---|---|---|---|
| 4,014,175 | A | 3/1977 | Brink | |
| 4,430,022 | A | 2/1984 | Kinnan | |
| 5,190,409 | A | 3/1993 | Hall | |
| 5,214,868 | A | 6/1993 | Persbacker | |
| 5,632,574 | A * | 5/1997 | Klaymar et al. | 405/179 |
| 5,741,088 | A | 4/1998 | Kleyman | |
| 5,949,373 | A | 9/1999 | Eslambolchi et al. | |
| 6,633,163 | B2 | 10/2003 | Fling | |
| 6,990,390 | B2 * | 1/2006 | Groth et al. | 700/180 |
| 7,038,454 | B2 | 5/2006 | Gard et al. | |
| 7,713,001 | B1 * | 5/2010 | Harlow et al. | 405/174 |
| 8,209,136 | B2 | 6/2012 | Li | |
| 2005/0180821 | A1 * | 8/2005 | Wilkinson | 405/184.5 |

* cited by examiner

*Primary Examiner* — Benjamin Fiorello
(74) *Attorney, Agent, or Firm* — Eugene Gierczak

(57) ABSTRACT

A trench plow blade for removing cable below ground which includes a plow member having upper and a lower end and a plow wedge disposed at the lower end, the trench plow blade receiving air or water for loosening the ground above the cable or reciprocally moving the plow member relative to the plow wedge. Apparatus for the removal of cable buried in the ground and a method relating to removal of buried cable with a trenching plow blade is disclosed.

8 Claims, 10 Drawing Sheets

CABLE RECOVERY DEVICE AND SYSTEM

FIELD OF INVENTION

This invention relates to a trench plow blade for removing cable buried below around; and in particular relates to apparatus for the removal of cable buried in the ground which includes a structure for loosening the ground above the buried cable. The invention also relates to a method of removing buried cable in the ground with a trench plow blade; including a method with a pre-survey cable location.

BACKGROUND TO THE INVENTION

There is a large amount of buried cable in the world. Much of this cable includes valuable metals such as copper or the like, the price of which has in recent years increased substantially. Some of this buried copper cable has been left in the ground to be replaced by optical fibre. The buried cable has substantial value because of its copper content and is therefore highly desirable to remove as well as for environmental reasons.

Most of the buried copper cable has been left in the ground as there has nor been an effective way of removing substantial lengths of the cable. In some cases, attempts have been made to uncover the buried cable by digging a trench above the cable using trenching equipment and then in a separate operation digging down to the cable and lifting it out. Such system is labour intensive.

In other eases, attempts have been made to automate the location of the buried cable by using GPS systems or radio frequency means which have not been very effective. Furthermore, some of the prior art equipment and methods have lacked controllers which are designed to keep the trenching equipment substantially over the buried cable.

Furthermore, many of the prior art devices lack effective means for pulling out the buried cable without snapping or cutting of the cable. Finally, in some cases, the ground has been compacted to such an extent that the prior art devices and methods have been ineffective to produce efficient cost-effective removal of the buried cable.

Various prior art has heretofore been issued for a variety of devices, systems and methods relating to cable trenching.

For example U.S. Pat. No. 5,190,409 relates to a conventional cable-laying apparatus has been adapted for the removal of cable. A trenching plow blade is towed behind is bulldozer or the like. Mounted above the area of the blade is a powered cable-pulling assembly. Once an initial length of cable is excavated and routed to the cable pulling assembly, the equipment is advanced along the line of the cable to dig the trench, preferably just a small distance above the cable, such as about a foot, and the cable pulling assembly is driven to pull the cable from the ground behind the advanced blade. The cable may be routed to lie on the ground behind the advancing apparatus, or alternatively may be routed forward over the cab of the bulldozer onto a powered rewind reel. The cable pulling assembly includes a pulling wheel rotatably mounted to the blade support assembly, rotated by a hydraulic motor through to reduction gearbox. A series of rollers are mounted between two roller support arms. The roller support arms are connected to each other and pivotally mounted at one end to the blade support assembly to rotate around a pivot pin. A hydraulic cylinder mounted between the blade support assembly and the roller support arms is operable to move the roller support arms to a closed position in which the rollers force the cable into the grooved portion of the pulling wheel, where teeth defined by the edges of squares rods into the cable to grip it securely for pulling.

Also U.S. Pat. No. 8,209,136 shows a line locator includes a signal detector to detect signals from an underground line; an error modeler that models a phase error in the signal from neighboring underground lines; and an enhanced electromagnetic field modeler that provides a location of the underground line based on the signal and a result from the error modeler.

Moreover U.S. Pat. No. 5,741,088 relates to an excavation apparatus comprising: a wedge member for driving through the ground and for slidingly contacting and lifting an overburden located beneath the surface of the ground substantially toward the surface of the ground; a driving attachment member for driving the wedge member below and substantially parallel to the surface of the ground; and a lateral support member attached to the wedge member for guiding the overburden across the wedge member. The apparatus may remove an existing utility line, install a new utility line, apply bedding material beneath a new utility line, or form as trench.

Furthermore U.S. Pat. No. 4,014,175 relates to a cable and pipe laying machine.

U.S. Pat. No. 6,633,163 B2 teaches an excavator vehicle has sensors thereon at different heights. Each sensor may have a coil which is generally horizontal and which detects the magnetic field generated by a current in a buried conductor. By detecting the relative magnitudes of the component of the field parallel to the ground, as detected by the sensors, it is possible to determine whether or not the excavator vehicle is proximate the buried conductor. A warning may be generated, or the excavating tool of the excavator vehicle controlled, to prevent the excavating tool damaging the buried conductor.

U.S. Pat. No. 7,038,454 B2 shows a system and method for detecting an underground object using magnetic field sensing.

Furthermore U.S. Pat. No. 7,759,824 B2 teaches a system and method use magnetic field sensing to detect underground objects for strike avoidance. The system detects magnetic field components for both passive distortions in the magnetic field indicative of a ferromagnetic object and active magnetic fields that are impressed on an object by a signal generator.

Moreover U.S. Pat. No. 5,949,373 relates to a method for accurately locating buried utility conveyance, comprising the step of: burying the conveyance while making at least one global positioning satellite location measurement of the location of the conveyance during burial.

U.S. Pat. No. 4,430,022 shows an underground cable installing apparatus and method utilizing a multi-positionable plow blade Finally U.S. Pat. No. 5,215,868 related to an apparatus for laying an underground member It is an object of this invention to provide a more efficient trench plow blade for removing a cable below ground. Furthermore, it is another object of this invention to provide more efficient apparatus and systems for removal of the cable buried in the ground including a method for removing buried cable in the ground with a trench plow blade.

It is an aspect of this invention to provide a trench plow blade for removing cable below ground, comprising: a plow member having an upper end and a lower end where the upper end is adapted to be disposed above ground and the lower end adapted to be disposed below ground; a plow wedge disposed at said lower end and adapted to lift the ground above the cable when the trench plow blade is moved through the ground. By lifting the over burden, the width of the plow wedge box allows for a greater margin of error.

It is another aspect of this invention to provide apparatus for the removal of cable buried in the ground comprising: a blade support assembly; a trenching plow blade suspended from the blade support assembly; structure for moving the blade support assembly and said trenching plow blade through the ground above the cable; structure for orienting said trenching plow blade in the ground substantially over said cable; radio frequency means for transmitting a signal to said buried cable, and for receiving a locate signal; microprocessing means communicating with said radio frequency means so as to communicate with said orienting means to orient said trenching plow blade in the ground substantially over said cable; pulling means for pulling cable removed from said ground as the moving structure moves the blade assembly and trenching plow blade through the ground above the cable, said pulling means communicating with said radio frequency means and said pulling means including means for piercing said cable to contact the metal in said cable so that said radio frequency means produces a locate signal in said buried cables.

Yet another aspect of this invention relates to it method removing buried cable in the ground with the trenching plow blade comprising: loosening the ground above the buried cable; moving said trenching plow blade through the around above the buried cable; pulling the buried cable out of the ground.

These and other objects and features will now be described in relation to the following drawings.

DETAILED DESCRIPTION OF THE INVENTION

Figure 1:
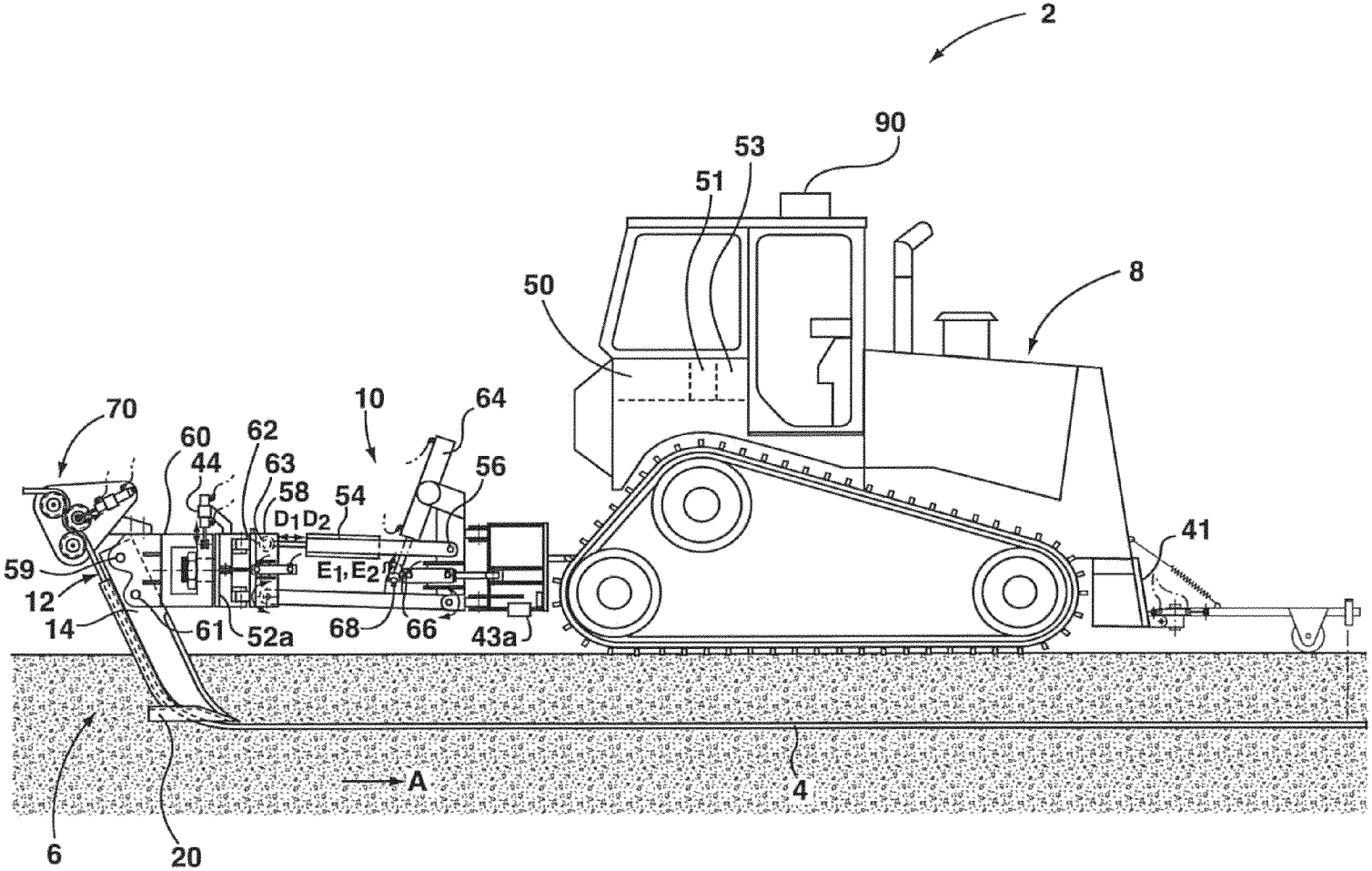
FIG. 1 is a front elevational view of the apparatus for the removal of cable buried in the around.

The invention to be described herein shows

Like parts have been given like numbers throughout the figures. In the drawings, embodiments of the invention as illustrated by way of example, it is expressly understood that the description and drawings are only for the purpose of illustration and as an aid to understanding, and are not intended as a definition of the limits of the invention.

FIG. 1 generally illustrates apparatus 2 for the removal of cable 4 buried in the ground 6. In particular, the apparatus 2 includes a moving means or vehicle 8 such as a bulldozer or the like having a blade support assembly 10. A trenching plow blade 12 is suspended from the blade support assembly 10 as shown. The trench plow blade 12 includes a plow member 14 having an upper end 16 and a lower end 18 where the upper and 16 is adapted to be disposed above ground 6 and the lower end 18 is adapted to be disposed below ground 6. A plow wedge 20 is disposed at the lower end 18 and adapted to lift the ground 6 above the cable 4 when the trench plow blade 12 is moved through the ground by the moving means 8.

The trench plow blade 12 includes a channel 22 for guiding a cable 4 removed from the ground 6.

The trench plow blade 12 can also include a conduit 24 for receiving air or water to the plow wedge 20 for loosening or lubricating the ground above the cable so as to make it easier for the plow wedge 20 to move through the ground 6 and easier to remove the buried cable 4. In other words the air or water will loosen the ground in the vicinity of the cable 4.

Figure 5B:
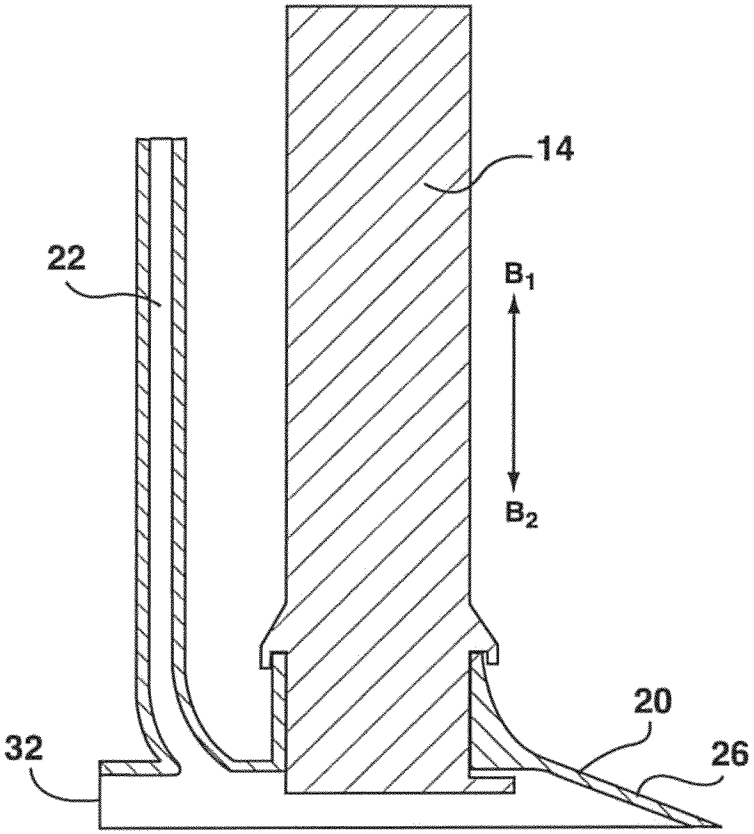
FIG. 5B is a cross sectional view of FIG. 5A.
Figure 5A:
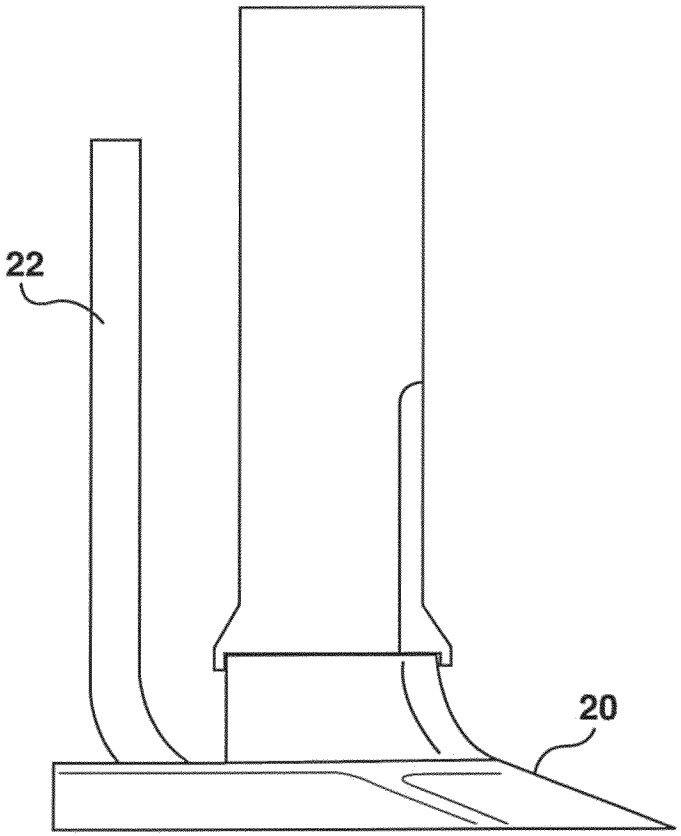
FIG. 5A is a front elevational view of one embodiment of the plow.
Figure 6:
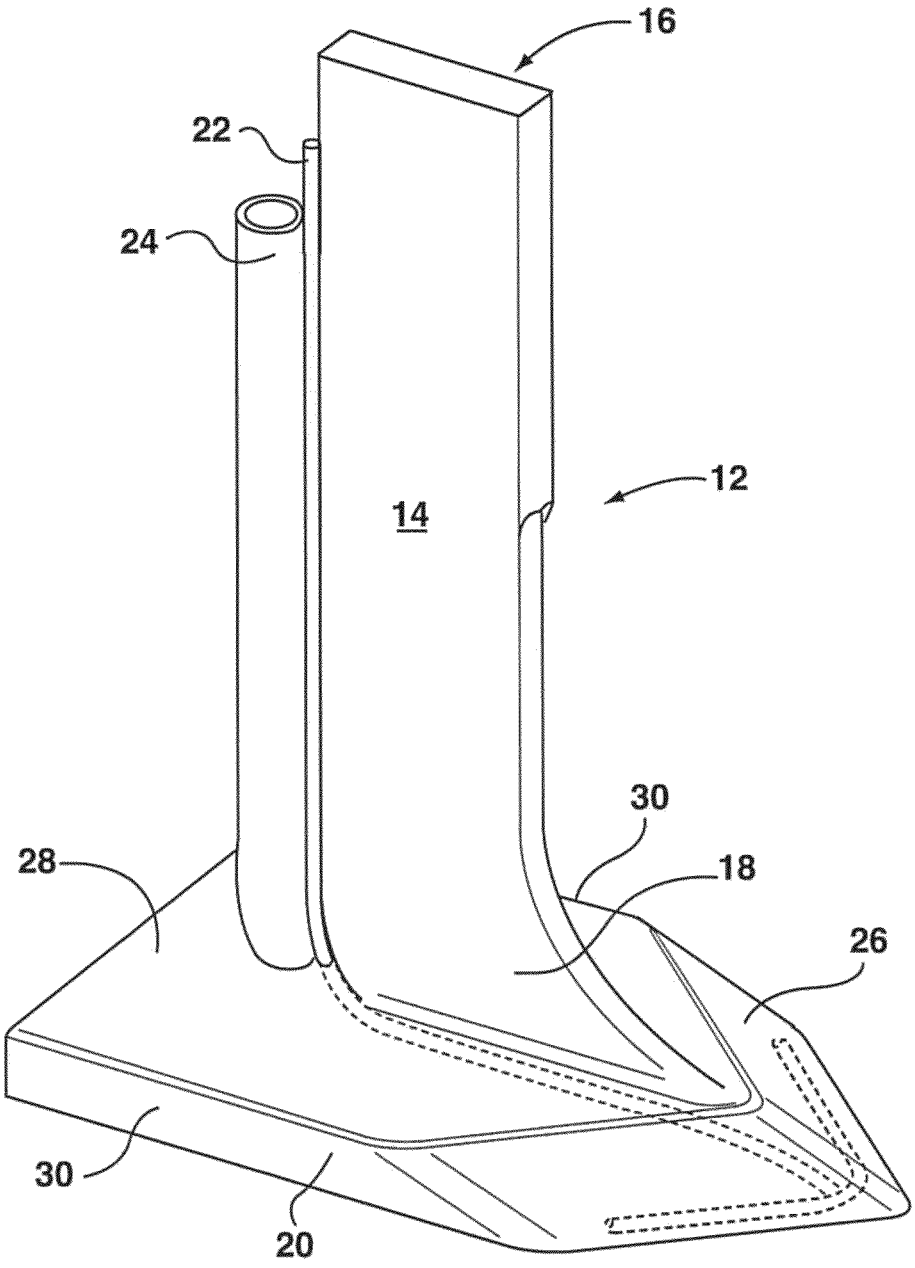
FIG. 6 is a perspective view of a trenching plow blade.
Figure 7:
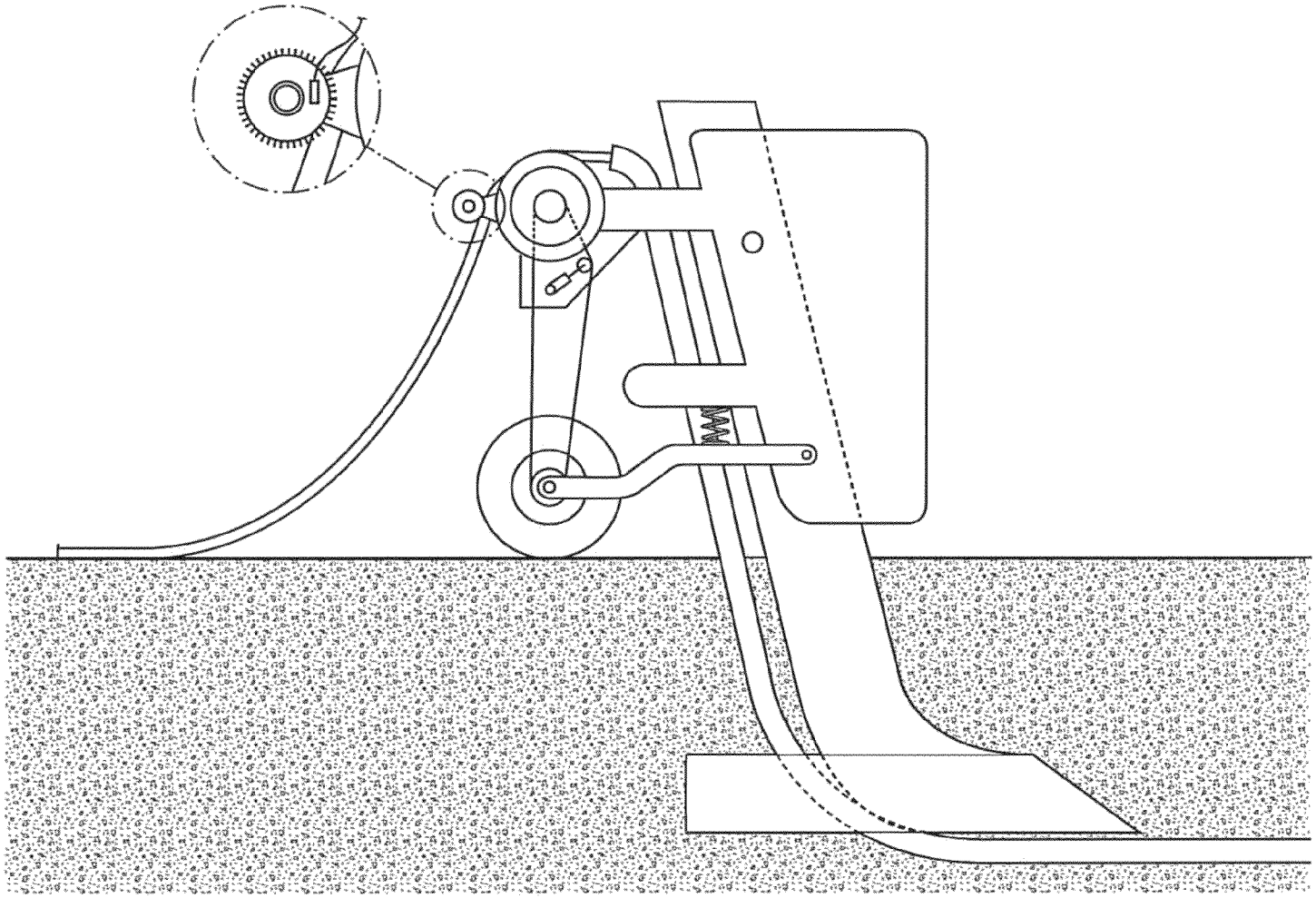
FIG. 7 is a side elevational view of another embodiment of the trench plow blade.

As best seen in FIGS. 5A, 5B and 6, the plow wedge 20 has an angled front face 26 which is adapted to cut to the ground as the plow member 14 is moved. In other words the ground will lift up and over the front face 26 as the plow wedge moves through the ground in the direction of arrow A. The plow wedge 20 is generally hollow having a top surface 28 with two space sides depending from the edges of the top surface 28. The plow wedge 20 also includes an open back 32 as shown. The top surface 28 can accommodate the channel 22 adapted to receive the pulled cable as well as the conduit 24. As the plow member 14 and the plow wedge 20 is moved through the ground by the moving means 8 in direction A. The ground 6 will tend to be pushed upwardly thereby relieving the pressure on the buried cable 4 making it easier to be removed.

Figure 1B:
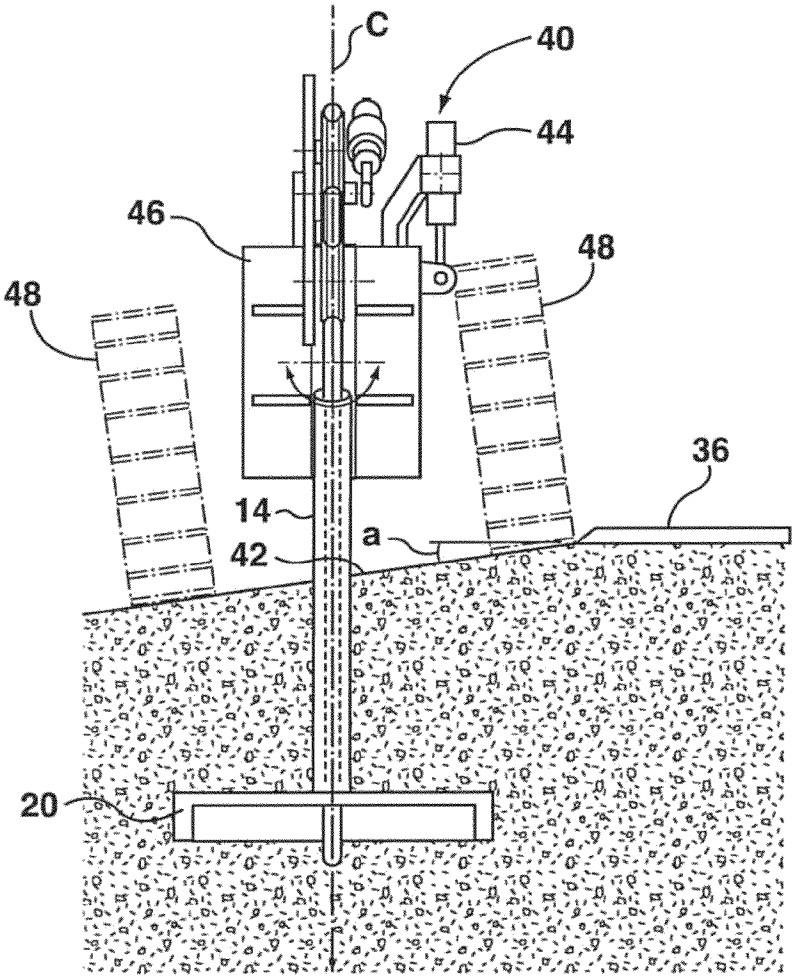
FIG. 1B is a elevational view of FIG. 1 taken from the left where the vehicle 8 is on an angled shoulder.
Figure 1A:
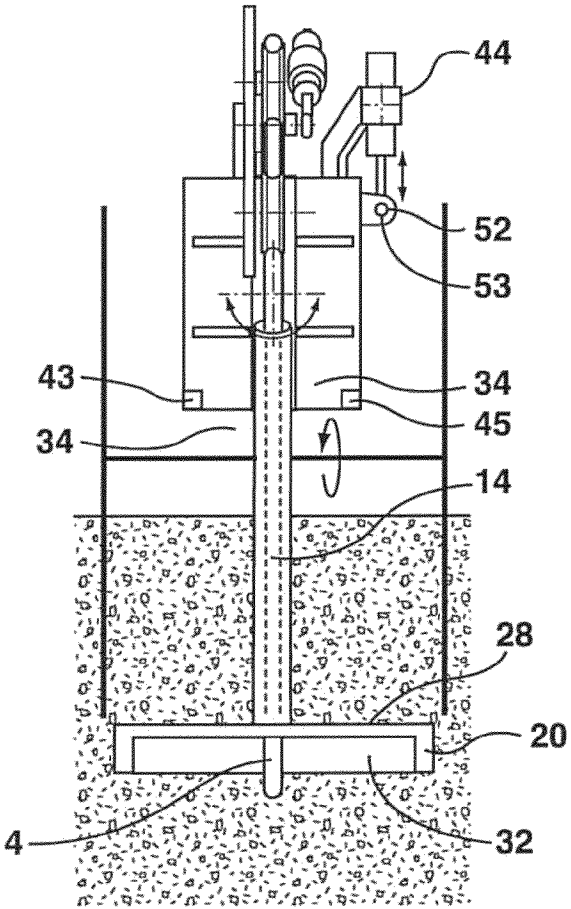
FIG. 1A is a side elevational view of FIG. 1 taken from the left side.

In another embodiment of the invention as shown in FIG. 5B, the plow member 14 is separate from the plow wedge 20 and can be reciprocally moved or vibrated between a first position B1 and a second position B2 so that the plow wedge 20 loosens the ground above the cable 4. Alternatively, at least one disk 34 can be disposed to the side of the plow member 14 and adapted to rotate and cut into the ground so as to loosen the around above or to the side of the buried cable 4. FIG. 1A shows the use of two round disks 34 disposed on other side of the plow member 14 so as to cut into the ground above the buried cable.

Figure 8A:
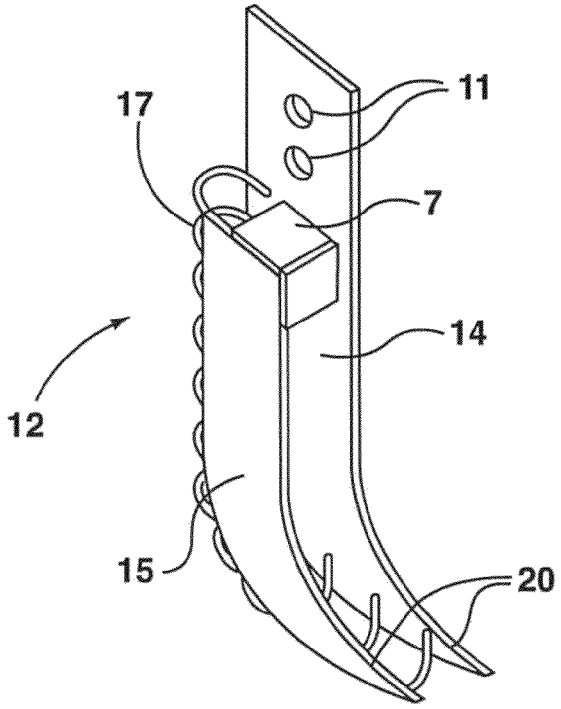
FIG. 8*a* is a perspective view of a further embodiment of a trench plow blade.
Figure 8B:
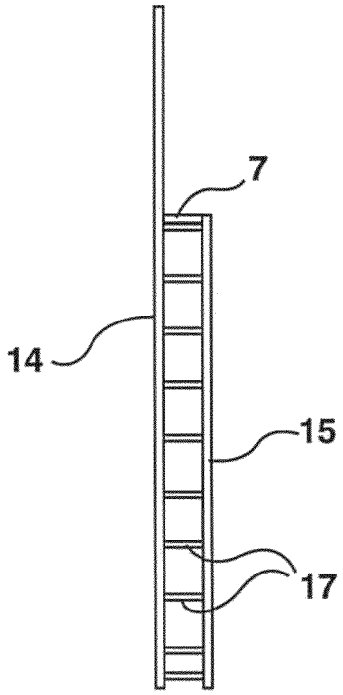
FIG. 8*b* is a rear devotional view of the trench plow blade of FIG. 8*a*.
Figure 8C:
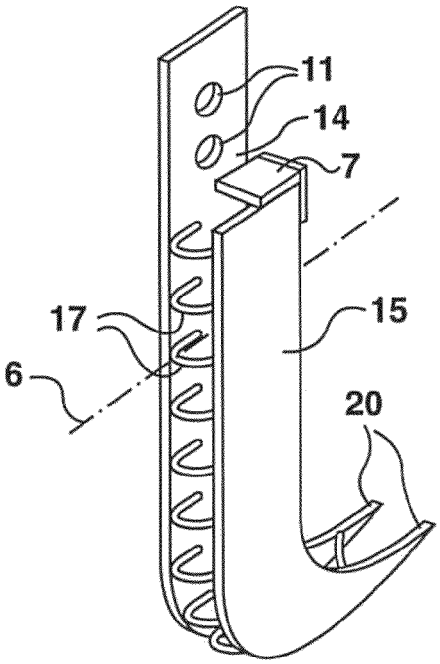
FIG. 8*c* is a rear perspective view of the trench plow blade of FIG. 8*a*.

A further embodiment of a trench plow blade is illustrated in FIGS. 8*a*, 8*b* and 8*c*. In particular FIG. 8*a* illustrates a perspective view of a plow member 14 having a side scoop 15. The side scoop 15 is spaced from the plow member 14 as illustrated in FIG. 8*b*. FIG. 8*b* is a back view of FIG. 8*a*. The rear or back is open as shown in FIG. 8*b* with connecting rod like members 17. There is a solid plate 7 near the top thereof. The lower end of the side scoop 15 and the lower end 18 of the blade member 14 includes a plow wedge 20 as shown. The upper end of the plow member 14 includes two holes 11 which are adapted to be connected to the blade member frame 60 which also has aligned holes 59 and 61 as shown. With the embodiment shown in FIGS. 8*a*, 8*b* and 8*c* the side scoop 15 will loosen the ground in the vicinity as the blade member 14 is pulled though the ground; where such loosened ground will exit through the openings created by the connecting members 17.

Figure 9:
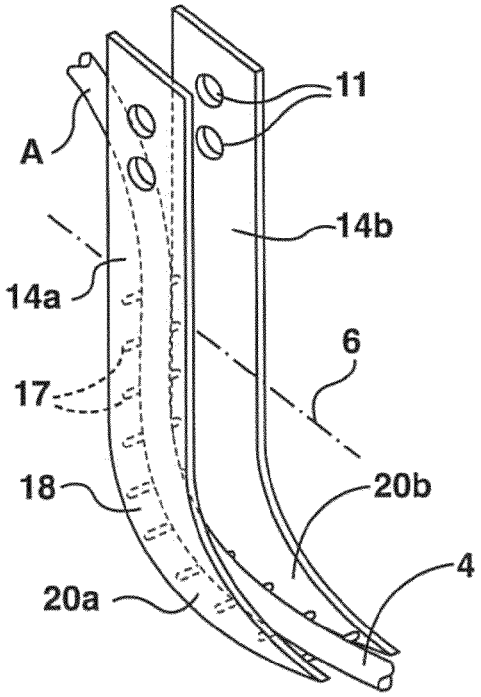
FIG. 9 is another embodiment of the trench plow blade.
Figure 10C:
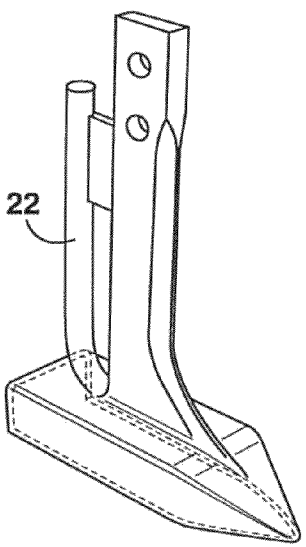
FIG. 10C is a side perspective view of another embodiment of the invention.
Figure 10E:
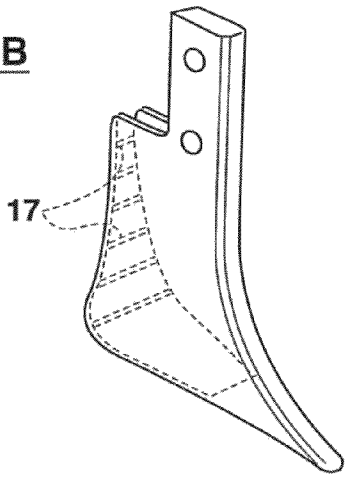
FIG. 10E is a side perspective view of another embodiment of the invention.
Figure 10B:
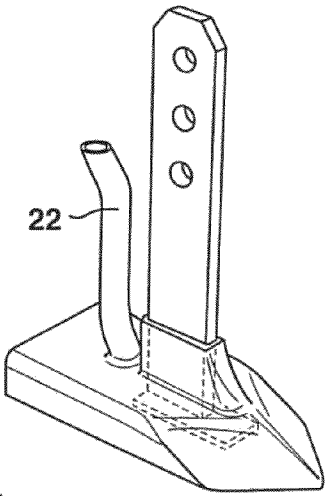
FIG. 10B is a side perspective view of another embodiment of the invention.
Figure 10D:
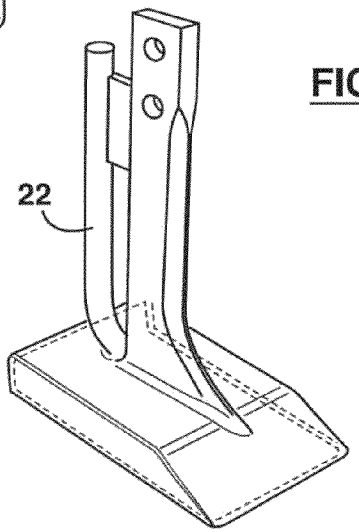
FIG. 10D is a side perspective view of another embodiment of the invention.
Figure 10A:
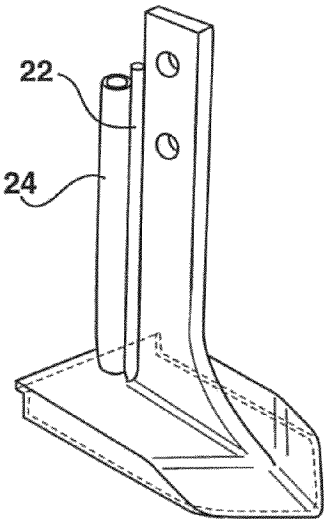
FIG. 10A is a side perspective view of one embodiment of the invention.

Yet another embodiment of the invention is shown in FIG. 9 whereby the blade member 14 comprises two spaced blade members 14A and 14B which are connected together by members 17 as shown. The lower end 18 of blade members 14A and 14B include plow wedge members 20A and 20B. The trench plow blade illustrated in FIG. 9 operates in a similar fashion to that described in relation to FIGS. 8*a*, 8*b* and 8*c*.

Other embodiments of the trench plow blade 12 are illustrated in FIGS. 10A, 10B, 10C, 10D, and 10E. The embodiment shown in FIG. 10E includes reinforcing bars or plates 17.

The invention as described herein also includes means 40 for orienting the plow member 14 and plow wedge 20 in a substantially vertical position over the buried cable 4 as the trench plow blade 12 is moved through the ground.

For example, much of the buried cable 4 has been laid close to a road or a highway particularly in the region of the shoulder on either side of the road or highway. Typically the shoulder 42 is disposed at an acute angle A from the road or highway 36 as best shown in FIG. 1B. Accordingly, the orienting means 40 which in one embodiment comprises of a hydraulic cylinder 44 is activated so as to move an orientating plate 40 as shown so that the trench plow blade 12 is substantially vertically orientated over the cable 4 even though the vehicle 8 and the vehicle tracks 48 may be disposed at an acute angle a since they ride on the shoulder 42 as shown. Other orientating means 40 can be utilized so as to compensate for the vertical disposition of the plow member 14 as the vehicle 8 moves over uneven ground.

Figure 2:
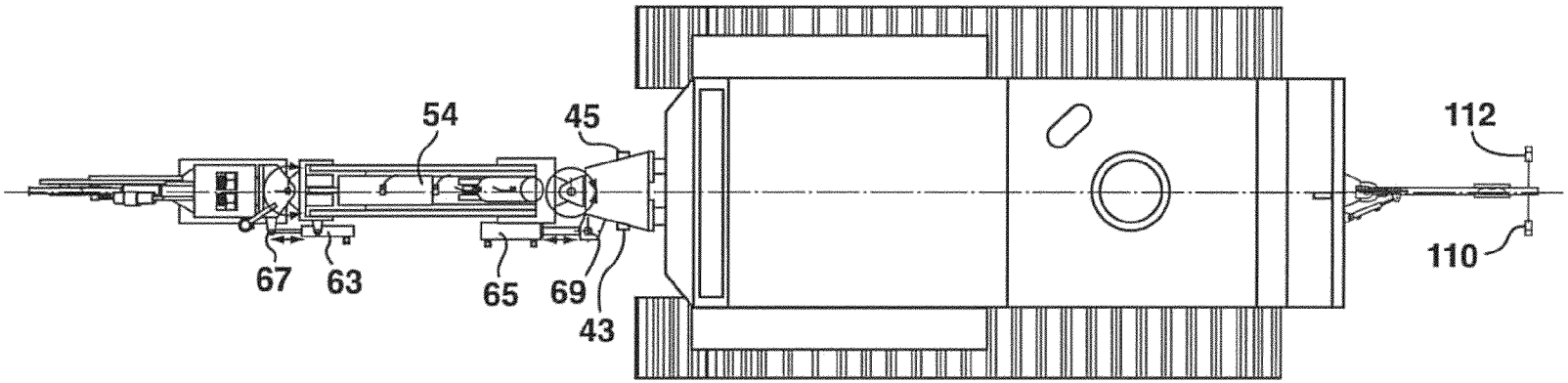
FIG. 2 is a top view of FIG. 1.
Figure 2B:
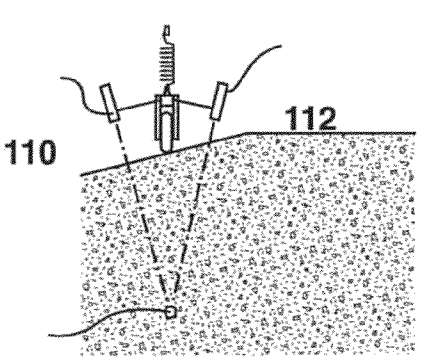
FIGS. 2A and 2B are front elevation views of the right side of FIG. 2 showing the orientation of the sensors when the vehicle is on a flat and angled surface respectively.
Figure 2A:
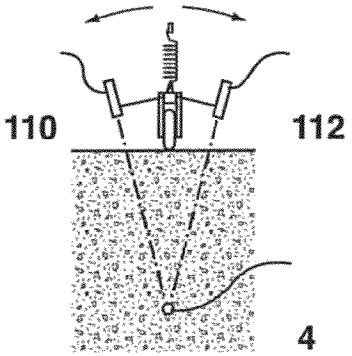
Figure 3:
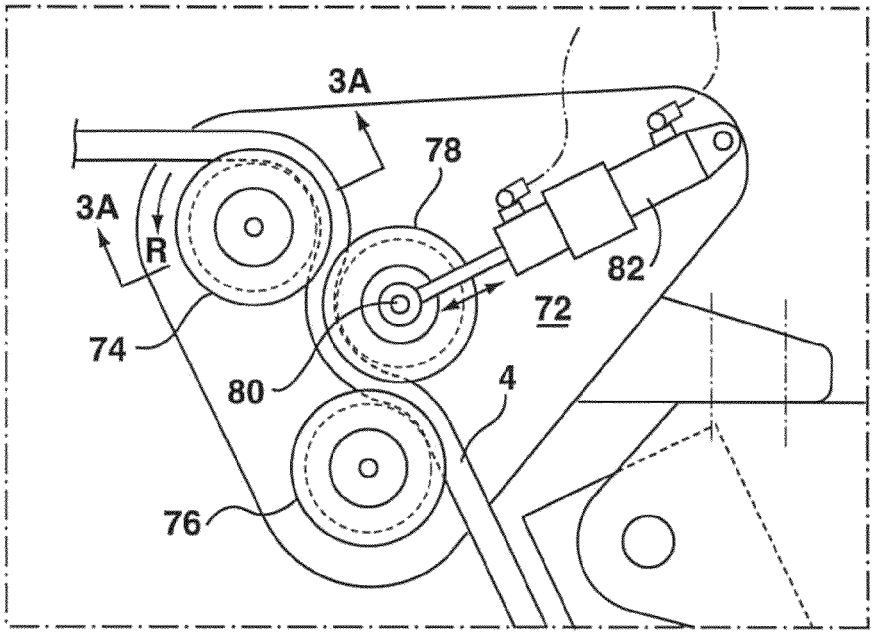
FIG. 3 is an isolated front view of the pulling structure.
Figure 3A:
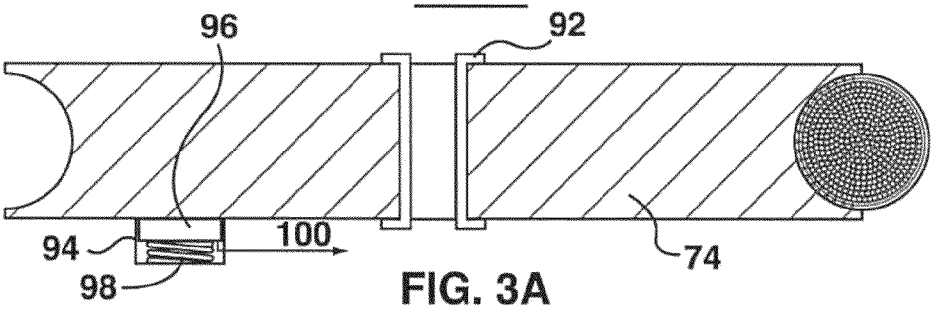
FIG. 3A is a cross-sectional view of FIG. 3 taken from the lines 3A-3A.
Figure 3B:
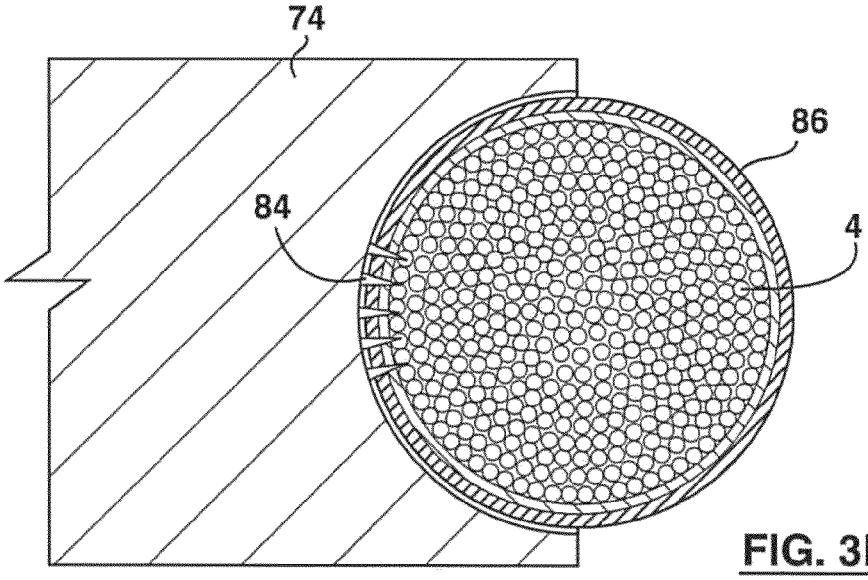
FIG. 3B is an enlarged view of a portion of FIG. 3A.
Figure 4:
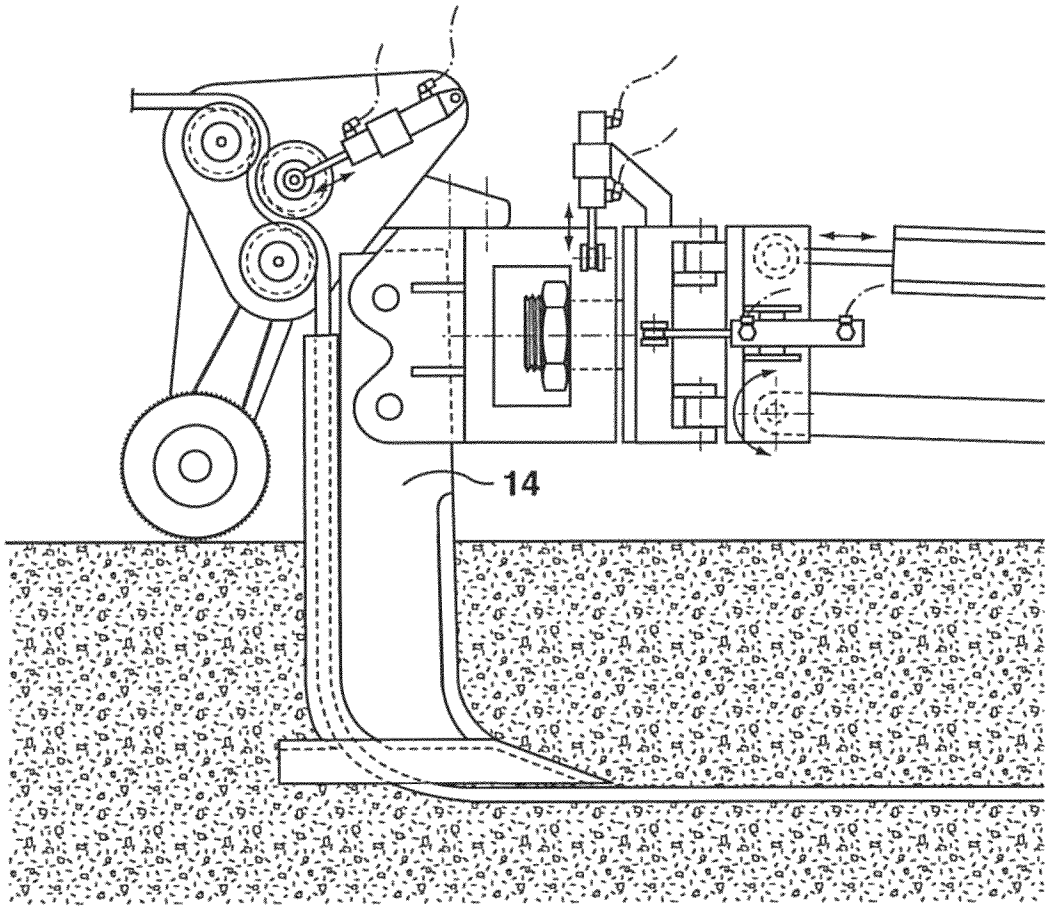
FIG. 4 is a front elevational view of the plow.

FIG. 2B similarly shows the front sensors 110 and 112 (that senses the cable 4) will similarly rotate so as to be substantially vertical by rotation of the gyro sensor 41

The invention as described herein also includes micro processing means 50 which is comprised of a computer, central processing unit, or the like. The micro processing means 50 is either wired to sensors to be described herein or communicates wirelessly with the various sensors to be described herein. The central processing unit 50 communicates with a level sensor 52. In one embodiment the level sensor 52*a* consists of a gyroscope that monitors angulation relative to the horizon. When the level sensor 52 or 52*a* senses that the vehicle 8 is at an angle a the sensor 52 sends a signal to the micro processing means 50 to thereby activate the hydraulic cylinder 44 so as to rotate the orientating plate 46 in a substantially vertical position whereby the axis c of the plow member 14 is moved to the substantially perpendicular position as shown in FIG. 1B. Alternatively the orientation can be controlled by a gyro 52; or manually override, the system as more fully particularized herein. The sensor 52 can be a rotational sensor at pivot point 53 or other sensor to determine the vertical orientation of the plow member 14.

The orientating means 40 also includes a second hydraulic cylinder 54 having one end 56 attached to the blade support assembly 10 and another end 58 attached to a blade member frame 60 which is attached to the blade member 14 so as to pull or push the blade member 14 in the direction of arrows D1 and D2. The central processing unit 50 receives wireless signals from a sensor 62 disposed at the pivot point 63 so as to adjust the position of the blade member 14 in a pre-determined disposition. In other words the sensor 63 determines the rotational disposition at pivot point 63. However other types of sensors 62 could be used.

The orientating means 40 can also include a third hydraulic cylinder 64 which is pivotally mounted on the blade support assembly 10 so that the hydraulic piston 66 can be moved in a direction of E1 and E2 and thereby move to the plow member 14 in a pre-selected position which is controlled by a computer 50 after receiving a wireless signal from a sensor 68. In particular, the second hydraulic cylinder 54 and third hydraulic cylinder 64 are utilized to adjust the depth of penetration of the plow wedge 20 into the ground 6.

The apparatus 2 includes positioning hydraulic cylinders 63 and 65 which communicate with sensors 67 and 69 as well as micro processing means 50 so as to control the left to right or lateral positioning of the trench plow blade 12. A joy stick connected to a display 51 on the central processing unit 50 may be utilized so as to control the lateral motion of the trench plow blade 12. The display 51 may be a touch screen display for human interface for controlling the orientation of the trench plow blade 12 over the cable 4.

The apparatus 10 also includes means 70 for pulling the cable 4 from the ground 6 as the vehicle or moving means 8 moves the blade assembly 10 and trench plow blade 12 through the ground 6 above the cable 4.

In one embodiment the pulling means 70 comprises a pulley frame 72 having drive pulleys 74 and 76 and an idler pulley 78. The idler pulley 78 includes an pressure adjusting means 82 having an axis 80. In one embodiment the pressure adjusting means comprises another hydraulic cylinder 82. The idler pulley 78 is connected to another hydraulic cylinder 82 that communicates with the central processing unit 50 so as to exert a desired force onto the cable 4 as the drive pulleys 74 and 76 rotate in a direction to pull the cable 4 out of the ground. It should be understood that pulleys 74 or 76 or both could be drive pulleys, and pulley 78 an idler pulley within the teachings of this application.

The drive pulleys 74 and 76 include piercing means 84 which in one embodiment comprises teeth 84 that penetrate the outside 86 of the cable 4 so as to make contact with the metal within the cable 4.

The apparatus 2 also includes radio frequency means 90 for transmitting a signal to the buried cable 4 and for receiving a locate signal. The micro processing means 50 communicates with the radio frequency means 90 so as to communicate with the orientating means 40 to orient the trench plow in the ground substantially over the cable 4.

The pulleys 74, 76 and 78 are adapted for rotation about their axis relative to the pulley frame 72. The pulley 78 includes an insulating sleeve 92 which is comprised from nylon or the like so as to be non-electrically conductive. The pulley 78 also includes a housing 94 which contains a brush 96 and a spring 98 so as to urge the brush 96 against the surface of pulley 78 as it rotates. A wire connector 100 is attached to the brush 96 at one end thereof and to the transmitter of the radio frequency means 90. Accordingly, as the teeth 84 on the drive pulley 74 pierce the outer surface of the cable 4 as the cable is being removed from the ground the teeth contact the metal sheeth 86 in the cable 4. A radio frequency signal from the radio frequency means 90 is communicated by wire 100, or alternatively, by wireless means with the brush 96 which makes electrical contact with the pulley 74 so as to induce or provide a signal within the cable 4 which is picked up by the receivers of the radio frequency means 90 so as to generate a signal within the cable thereby permitting the micro processing means 50 to determine the location of the cable 4 and guide the various hydraulic cylinders to move the blade member 14 particularly the blade wedge 20 over the cable in a more efficient fashion.

Sensors 110 and 112 pick up the radio frequency from the cable 4 and communicate with the micro processing means 50 which guides the orientating means 40 so that the plow wedge 20 is substantially over the cable 4. Two sensors 110 and 112 are utilized so as to more accurately read the location of the buried cable 4.

More particularly the radio frequency means 90 induces a signal into the wire or cable 4. The frequency and method of connection is dependent on the wire type, the ground density and composition, and surrounding environment.

In operation the tractor or vehicle 8 is positioned over the wire or cable 4. The micro processing means 50 can include a Human Machine interface (HMI) display 51 which displays the cable 4 position; whereby the operator can manually align the vehicle 8 with the cable 4. In one embodiment a joy stick can be utilized to provide manual positioning of the trench plow blade 12 which is controlled by the micro processing means 50 through the display 51.

Encoders 43 and 45 can be mounted at the rear of the vehicle 8 or closer to the front of the monitoring frame 55 as shown by 43*a* and 45*a*. The encoders 43 and 45 are mounted at the bottom of the mounting frame 55 at an angle that converges to locate the cable 4 especially when the bulldozer 8 turns the back of the frame 55 will have a tendency to move to the "side" of the cable 4. The encoders 43 and 45 will assert in "re orientating" over the cable 4 adjacent to the trench plow blade 12 to provide right to left hand or lateral position detection. The data from the encoders 43 and 45 is sent to the micro processing means 50 and is used for plow position feedback.

The microprocessing means 50 includes the appropriate application software having directions for the activation of the orienting means 40 and radio frequency means 90 according to predetermined parameters.

In another embodiment of the invention a GPS system may be utilized to locate the position of the cable 4. More particularly a hand held UPS cable locator (which in one embodiment can comprise a radio tech locator computer) may be held by an individual who will walk over the position of the buried cable 4. The hand held GPS device in association with a GPS system digitally stores the location of the buried cable which data may than be downloaded into the micro processing unit 50 as a pre survey. This downloaded information or data may then be used by the central processing unit to control the various orientation means previously discussed as well as the hydraulic cylinders. In particular, the invention includes a valve body 53 having valves that communicate with the cylinders. The valve body 53 includes manually operable valves to move the cylinder as well as solenoid switches which are electronically or digitally controlled by the micro processor 50.

In another embodiment a current or radio frequency may be injected into the cable 4 by a conductive method which consists of connecting a signal directly to the cable 4 through means of a clip. This method will incorporate frequencies in the range of 500 kHz to 100 kHz. An example of this method consists of a device sold under the trade-mark Metrotech or Radiotech which are manual cable locators. Alternatively these devices can be modified by adding a GPS locator and data memory cards for storing the location data. The modified devices can have download and upload ports to download or upload data to the microprocessor 50.

Alternatively in another embodiment the individual may spray paint portions of the surface of the ground to provide a "rough" positioning of the buried cable.

Alternatively the signal can be injected by an inductive clamp method whereby the signal will be applied through an inductive clamp. Both ends of the cable 4 will be grounded. This method will incorporate frequencies in the range of 10 kHz to 100 kHz.

The cable tracking receivers 110 and 112 at the front, and/or the tracking system at the rear 43 and 45 or 43*a* and 45*a*. previously described will receive data from the cable tracking receiver that is sent to the micro processing means 50 for wire position calculation. The wire position data is sent to the Human Machine Interface touch screen display. A vehicle operator uses this information to steer and maintain the vehicle 8 over the cable 4.

Two cable tracking receivers 120 and 122 mounted at the rear of the vehicle 8 can be set apart for example by two feet or the like with for example a ten degree adjustable angle adjustment. Other spacing and degree adjustment angles then can be utilized. Data from cable tracking receivers 120 and 122 is sent to the micro processing means 50 for wire position calculation and Human Machine Interface touch screen display 51. The wire position data will be used to maintain the correct lateral or right and left position of the trench plow blade 12 over the cable 4.

The cable 4 depth tracking receiver is mounted to the front of the trench plow blade 12 to track and adjust the plow depth. Data from the cable depth tracking receiver is sent to the micro processing means 50 for wire depth calculation and Human Machine Interface touch screen display. The wire data will be used to maintain the correct plow depth over the wire.

Accordingly, the invention as described herein relates to apparatus 2 for the removal of cable 4 buried in the ground 6 which comprises a blade support assembly 10, a trenching plow blade 12 suspended from the blade support assembly 10, means 8 for moving the blade support assembly 10 and the trenching plow blade 12 through the ground 6 above the cable 4; and orientating means 40, for orientating the trenching plow blade 12 in the ground 6 substantially over the cable 4. A radio frequency means 90 transmit a signal to the buried cable 4 and for receiving a locate signal. Micro processing means 50 communicate with the radio frequency means 90 so as to communicate with the orientating means 40 to orient the trench plow 12 in the ground 6 substantially over the cable 4. Pulley means 70 pulled cable 4 from the ground 6 as the vehicle 8 moves the blade assembly 10 and the trench plow blade 12 through the ground 6 above the cable 4 where the pulley means 70 communicates with the radio frequency means 90. The pulley means 70 include piercing means 84 for piercing the cable 4 to contact the metal in the cable 4 so that the radio frequency means 90 produce a locate signal in the buried cable.

The invention as described herein also relates to a method of removing buried cable 4 in the ground 6 with a trench plow blade 12 which comprises; moving the trench plow blade 12 through the ground 6 above the buried cable 4; loosening the ground 6 above the buried cable 4; pulling the buried cable 4 out of the ground.

The cable 4 can be wound on a spool as it is being pulled out of the ground or alternatively the buried cable may be first pulled out of the ground and laid on top of the ground and gathered thereafter about a spool.

The vehicle or tractor 8 is positioned over the cable 4. The Human Machine Interface touch screen 51 displays the cable position 4. The operator manually aligns the vehicle over the cable 4 by use for example of is steering wheel or joy stick as previously mentioned. The operator then manually adjusts the plow to the correct depth and position over the cable 4. The vehicle 8 is set to the desired speed. The operator then can select automatic operation.

The operation the operator steers the vehicle to maintain the pre-track tracking receiver over the cable 4. For example a circle on the display 51 can be manually moved by the operator so as to centre over cross-hairs on the display that represents the cable 4 location. The Human Machine Interface touch screen display 51 continually displays the wire or cable position and depth. The micro processing means 50 maintains the plow position over the cable 4.

The invention as described herein relates to apparatus for recovering buried cable or conductors abandoned by utilities or other entities that have left buried conducting wires. The apparatus minimizes the amount of burden that must be displaced from above the conductor or cable by tracking the position of the conductor or cable in real time using electronic wire position detection. The apparatus uses a signal generator to produce tracking current or frequency that is injected into the buried cable 4. The control system or micro processing means of the apparatus 2 is configured to position the plow which is powered and pulled by the vehicle 8 such that the furrow that is created by the plow is controlled to remain centered on the buried conductor or cable. The related apparatus for collecting the conductor uses power from its power unit to lift the conductor using the plowed furrow at a controlled tension and stores the conductor for transport.

The apparatus 2 described herein provides improved accuracy. Also the invention described will generally increase the speed and accuracy of the cable removal as compared to the prior art. Furthermore the apparatus 2 reduces the likelihood of breaking the recovered cable or conductor 4 by virtue of alignment of the extraction direction with the furrow and control of the lifting tension applied to the buried cable 4. There is an environmental advantage in removing cable from the ground. Also for every pound of copper removed from the ground you eliminate the need for refining the copper metal which has a negative impact on the environment.

Moreover the control strategy for the apparatus 2 utilizes an injected test signal on the buried cable 4 to position the plow at the correct depth and follow the buried path of the buried cable 4 as the vehicle 8 pulls the plow 12.

Furthermore electric isolation of the cable 4 extraction and transport apparatus 2 from the plow 12 and the vehicle 8 avoids stray signal interference with position detection.

I claim:

1. Apparatus for the removal of cable buried in the ground comprising:

(a) blade support assembly;

(b) trenching plow blade suspended from the blade support assembly;

(c) a vehicle for moving the blade support assembly and said trenching plow blade through the ground above the cable;

(d) at least one cylinder carried by said blade support assembly for orienting said trenching plow blade in the ground substantially over said cable;

(e) a radio frequency for transmitting a signal to said buried cable, and for receiving a locate signal;

(f) microprocessing means communicating with said radio frequency so as to communicate with said at least one cylinder to orient said trenching plow blade in the ground substantially over said cable;

(g) at least one drive pully for pulling cable removed from said ground as the vehicle moves the blade assembly and trenching plow blade through the ground above the cable, said at least one drive pully communicating with said radio frequency and and the at least one drive pully including means to pierce said cable to contact the metal in said cable so that said radio frequency produces a locate signal in said buried cables.

2. Apparatus as claimed in claim 1 wherein said vehicle comprises a bulldozer.

3. Apparatus as claimed in claim 2 wherein said at least one cylinder includes a hydraulic cylinder to orient said trenching plow blade in the ground substantially over the buried cable.

4. Apparatus as claimed in claim 3 wherein said at least one drive pully comprises at least two pulleys for pulling said cable removed from the ground, wherein at least one of the pulleys has said piercing means.

5. Apparatus as claimed in claim 4 wherein said piercing means comprises teeth for piercing the outer surface of said cable.

6. Apparatus as claimed in claim 5 wherein said trenching plow blade includes means to loosen the ground above the buried cable.

7. Apparatus as claimed in claim 6 wherein said loosening means includes water or air injected into the ground, vibrating the trench plow blade above the buried cable between a first and a second position, a side scoop or at least one disc to cut into the ground.

8. Apparatus for the removal of cable buried in the ground comprising:

(a) a blade support assembly;

(b) a trenching plow blade suspended from the blade support assembly;

(c) a vehicle for moving the blade support assembly and said trenching plow blade through the ground above the cable;

(d) a radio frequency for transmitting a signal to said buried cable, and for receiving a locate signal;

(e) a microprocessor for communicating with said radio frequency so as to communicate with said at least one cylinder to orient said trenching plow blade in the ground substantially over said cable; and (f) piercing means to pierce said cable to contact metal in the cable to produce a locate signal.

* * * * *